US007144438B2

(12) United States Patent
Lee et al.

(10) Patent No.: US 7,144,438 B2
(45) Date of Patent: Dec. 5, 2006

(54) DUST COLLECTING CONTAINER FOR VACUUM CLEANER

(75) Inventors: Hyun-Ju Lee, Jeonju (KR); Dong-Hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 167 days.

(21) Appl. No.: 10/625,922

(22) Filed: Jul. 24, 2003

(65) Prior Publication Data

US 2004/0163368 A1 Aug. 26, 2004

(30) Foreign Application Priority Data

Feb. 21, 2003 (KR) ..... 10-2003-0011118

(51) Int. Cl.
*B01D 29/56* (2006.01)

(52) U.S. Cl. ..... 55/429; 55/481; 55/485; 55/486; 55/487; 55/502; 55/506; 55/DIG. 3; 15/353; 96/416

(58) Field of Classification Search ..... 55/429, 55/481, 485, 486, 487, 502, 505, 506, 507, 55/DIG. 3; 96/416; 15/353
See application file for complete search history.

(56) References Cited

U.S. PATENT DOCUMENTS

| | | | | |
|---|---|---|---|---|
| 3,621,640 | A * | 11/1971 | Ohno et al. | 55/300 |
| 4,689,059 | A * | 8/1987 | Magdelain | 55/382 |
| 4,938,309 | A | 7/1990 | Emdy | |
| 5,593,479 | A | 1/1997 | Frey et al. | |
| 2004/0205926 | A1 * | 10/2004 | Fawcett | 15/326 |

FOREIGN PATENT DOCUMENTS

| | | |
|---|---|---|
| DE | 3150299 | 12/1981 |
| DE | 32 16 116 | 11/1983 |
| DE | 89 10 579 | 10/1989 |
| DE | 3 199 11 226 | 9/2000 |
| EP | 1321087 A1 | 6/2003 |
| GB | 344210 | 3/1931 |
| GB | 2092472 A | 8/1982 |
| GB | 2246717 | 2/1992 |
| GB | 2246717 A | 2/1992 |
| GB | 2388769 A | 11/2003 |
| RU | 984456 | 1/1983 |

OTHER PUBLICATIONS

Russian Office Action—Application No. 2003117088 dated Oct. 4, 2004.

(Continued)

*Primary Examiner*—Robert A. Hopkins
(74) *Attorney, Agent, or Firm*—Ohlandt, Greeley, Ruggiero & Perle, L.L.P.

(57) ABSTRACT

A dust collecting container for a vacuum cleaner is removably mounted in a suction chamber of a cleaner body to filter a dust from a dust-laden air being drawn into the suction chamber through an air suction hole that is connected with the outside. The dust collecting container has a dust collecting casing having a connecting hole connected with the air suction hole and a discharge portion for discharging the drawn air, and a filter assembly having at least three filters, and removably mounted at the discharge portion. With the plurality of filters that respectively and consecutively filter from the largest to the most minute particles of the dust-laden air drawn in the dust collecting chamber, the dust collecting container is rarely blocked even for a long period of use.

13 Claims, 5 Drawing Sheets

OTHER PUBLICATIONS

Great Britain Search Report Application No. GB0325418.2, dated Apr. 16, 2004.
Canadian Search Report.
Chinese Office Action dated Oct. 28, 2005 in connection with Chinese Patent Application No. 03138107.3 ( with English translation).

* cited by examiner

DUST COLLECTING CONTAINER FOR VACUUM CLEANER

BACKGROUND OF THE INVENTION

1. Field of the Invention

The present invention relates generally to a vacuum cleaner, and more particularly, to a dust collecting container for a vacuum cleaner which is reusable after washing.

2. Description of the Prior Art

Generally, a vacuum cleaner draws in dust-laden air with a suction force generated at a suction port by a vacuum generating means, and separates dust and dirt from the air and collect in a dust collecting means.

As for the dust collecting means, a dust bag is generally used. The dust bag is separated from the cleaner body and disposed when it is full of dust, and due to such consumable nature of the dust bag, the cost of using vacuum cleaner increases.

Recently, a reusable dust collecting container has been suggested in the disposable dust bag's place. When it is full of dust, the reusable dust collecting container is separated from the cleaner body for washing and then re-mounted in the cleaner body.

FIGS. 1 and 2 illustrate a dust collecting container and a vacuum cleaner using the same, which was disclosed by the same application in the patent application No. 10-2002-0028321 filed May 22, 2002 in the Republic of Korea.

As shown in FIGS. 1 and 2, the dust collecting container 100 includes a dust collecting casing 110 having a similar appearance as that of a suction chamber 11 of the cleaner body 10, a door 120 and a filter 130.

The dust collecting casing 110 includes a front side 111 having a first opening 111*a*, upper and lower sides 112, 113 extended each from upper and lower portions of the front side 111, lateral sides 114, 115 extended from both sides of the front side 111, and a rear side 116 extended from upper and lower sides 112, 113 and lateral sides 114, 115 and having a second opening 116*a* formed therein. In the lateral sides 114, 115 formed guide grooves 114*a*, 114*b*, 115*a*, 115*b* to receive fixing guides 11*a*, 11*b*, 12*a*, 12*b* of the suction chamber 11. Also on the upper side 112 are formed a pair of grip recesses 112*a*, 112*b* for the user to easily take the dust collecting casing 110 out from the suction chamber 11.

The door 120 is movably connected on the first opening 111*a* to pivot open and close the first opening 111*a*. At the center of the door 120 is formed a connecting hole 120*a* which is connected with an air suction hole 10*b* of the suction chamber 10*a*.

The filter 130 is made of non-woven fabric 131, and is detachably disposed on the second opening 116*a* of the rear side 116. There is also provided a fixing means 140, which includes a filter mounting portion 141 extended inwards the second opening 116*a*, a fixing rib 142 and a fixing frame 143 fit in the fixing rib 142. As the filter 130 is mounted in the filter mounting portion 141, and the fixing frame 143 is fit in the fixing rib 142, the fixing frame 143 supports front boundary of the filter 130, and thus, the filter 130 is secured in place. The filter 130 defines a discharge path of the air drawn in through the suction hole 10*a*, and also filters out various foreign substances from the discharged air.

The dust collecting container 100 is mounted in the suction chamber 10*a*, with the fixing guides 12*a*, 12*b*, 13*a*, 13*b* of the suction chamber 11 being inserted in the guide grooves 114*a*, 114*b*, 115*a*, 115*b*. Accordingly, the dust collecting container 100 remains in a stable mounting position with the connecting hole 120*a* being aligned with the air suction hole 10*b* of the suction chamber 11. As the vacuum motor (not shown) of the cleaner is driven, the dust-laden air is drawn into the dust collecting container 100 through the air suction hole 10*b* and the connecting hole 120*a*. Dust and dirt are separated from the air as it passes through the filter 130, and collected in the dust collecting casing 110. The clean air s discharged outside through the filter 130. Meanwhile, if the dust collecting container 100 is filled with dust and dirt, the user separates the dust collecting container 100 from the suction chamber 10*a*, and shakes the dust off from the dust collecting casing 110. Then the user separates the filter 130 from the dust collecting casing 110, washes it, and re-mounts in the vacuum cleaner.

However, in the above-described dust collecting container 100, as the various foreign substances, large or small, are attached to the filter 130 made of non-woven fabric 131, the filter 130 is frequently blocked, and the user has to clean the filter 130 and the dust collecting container 100 very often.

SUMMARY OF THE INVENTION

Accordingly, it is an object of the present invention to provide a dust collecting container for a vacuum cleaner, which has a plurality of filters to cover different filtering areas according to the size of the dust and thus are not blocked during the long use.

The above object is accomplished by a dust collecting container according to the present invention for a vacuum cleaner, which is removably mounted in a suction chamber of a cleaner body to filter a dust from a dust-laden air being drawn into the suction chamber through an air suction hole that is connected with the outside. The dust collecting container includes a dust collecting casing comprising a connecting hole connected with the air suction hole and a discharge portion for discharging the drawn air, and a filter assembly comprising at least three filters, and removably mounted at the discharge portion.

In the dust collecting container constructed as above according to the present invention, the filter assembly includes a first, a second and a third filters which are porous in nature and provided in a consecutive order, the pores of the second filter being smaller than those of the first filter, the pores of the third filter being smaller than those of the second filter, and the dust-laden air drawn in through the connecting hole passes through the first, the second and the third filters in turn.

The first filter may be a net member, while the second filter is a sponge. The third filter may be a non-woven fabric.

The third filter includes an outer frame disposed in close contact with a boundary of a discharge portion of the dust collecting casing, and a non-woven fabric provided at the outer frame, defining a fluid passage through which the air is discharged from inside of the dust collecting casing to the outside and at the same time filtering minute particles from the air passed through the second filter.

The outer frame is provided with a hook member protruding outward for hooking with a hooking protrusion formed on an upper portion of the dust collecting casing.

The outer frame is provided with a connecting rib protruding therefrom for being inserted in a slit which is formed in the lower portion of the dust collecting casing.

The dust collecting casing is provided with an extended portion formed on the connecting hole, the extended portion being provided with a sealing means for sealing in between the air suction hole and the connecting hole. The sealing means includes a first sealing member, extended at one end toward the outer side of the extended portion to a close contact with a boundary of the air suction hole, and a pressing means for selectively pressing the first sealing member towards the air suction hole.

The pressing means includes a guide rail provided on the outer circumference of the extended portion in an oblique fashion, and a press ring provided with a guide protrusion at an inner circumference thereof for being inserted in the guide rail, the press ring disposed such that it is moved along the outer circumference of the extended portion with the guide rail thereof being inserted in the guide rail. The pressing ring moving along the guide rail pushes the second sealing member towards the air suction hole.

The first sealing member includes a body which is inserted to a contact with an inner circumference of the extended portion, a tight-contact portion provided at one end of the body, protruding from the outer end of the extended portion towards the air suction hole, and a backflow preventing portion provided at the other end of the body, for preventing backflow of the dust of the dust collecting casing.

The outer frame is provided with a second sealing member provided at an inner boundary thereof, and in tight contact with an inner boundary of the dust collecting casing which defines a dust collecting chamber, and the dust collecting chamber is sealed as the second sealing member is contacted with the inner boundary of the dust collecting casing tightly.

The dust collecting casing is provided with a fixing rail at an outer portion thereof in correspondence with a fixing rib provided to a suction chamber of the cleaner body, and the dust collecting casing is mounted in the suction chamber as the fixing rib is inserted in the fixing rail.

The dust collecting casing is made of a transparent material.

DETAILED DESCRIPTION OF THE PREFERRED EMBODIMENTS

The above object and advantages of the present invention become more apparent by the following description of the preferred embodiments of the present invention with reference to the accompanying drawings.

Figure 1:
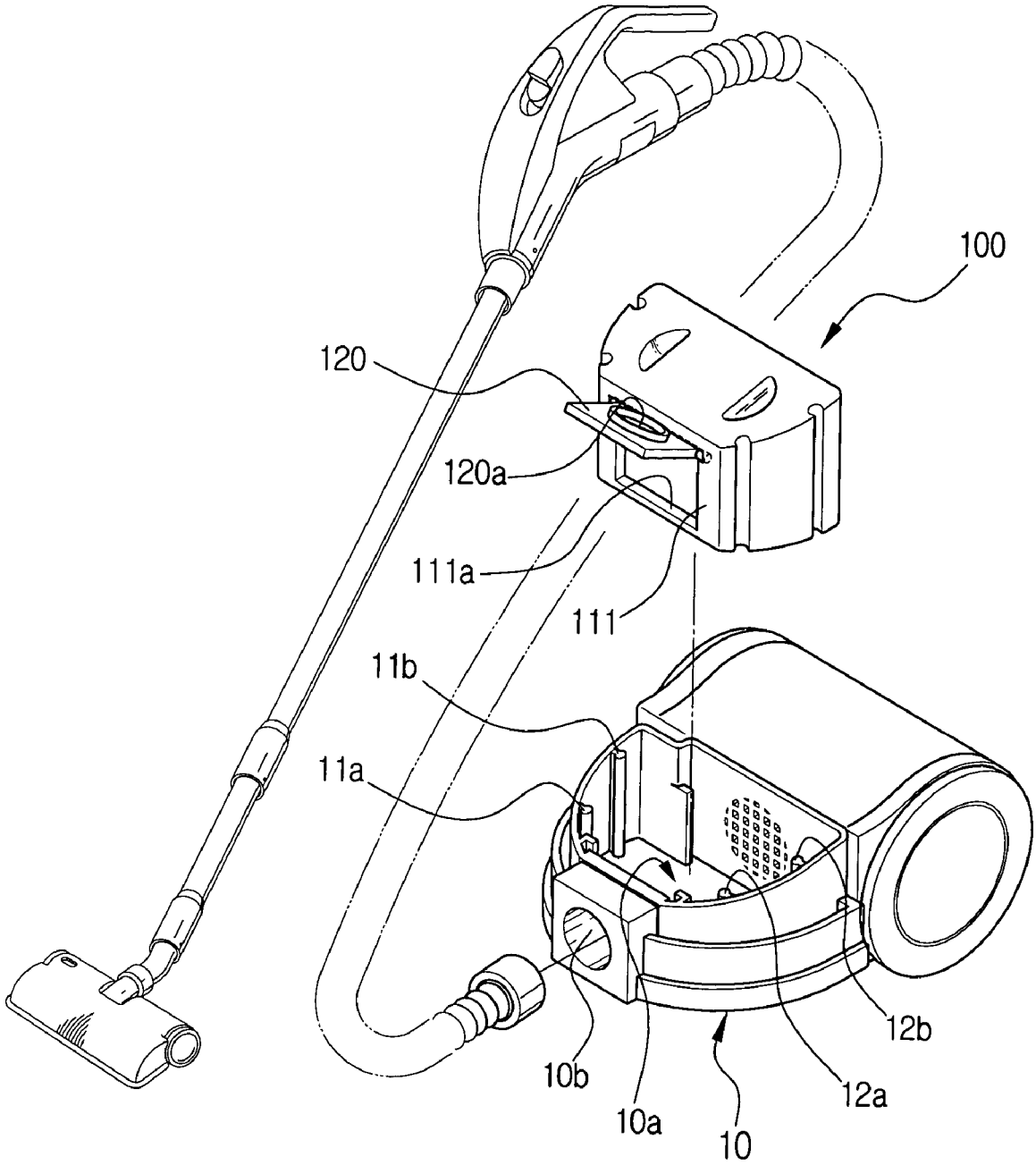
FIG. 1 is a perspective view of a dust collecting container and a vacuum cleaner employing the same, disclosed in the Republic of Korean Patent Application No. 10-2002-0028321 filed by the same applicant.
Figure 2:
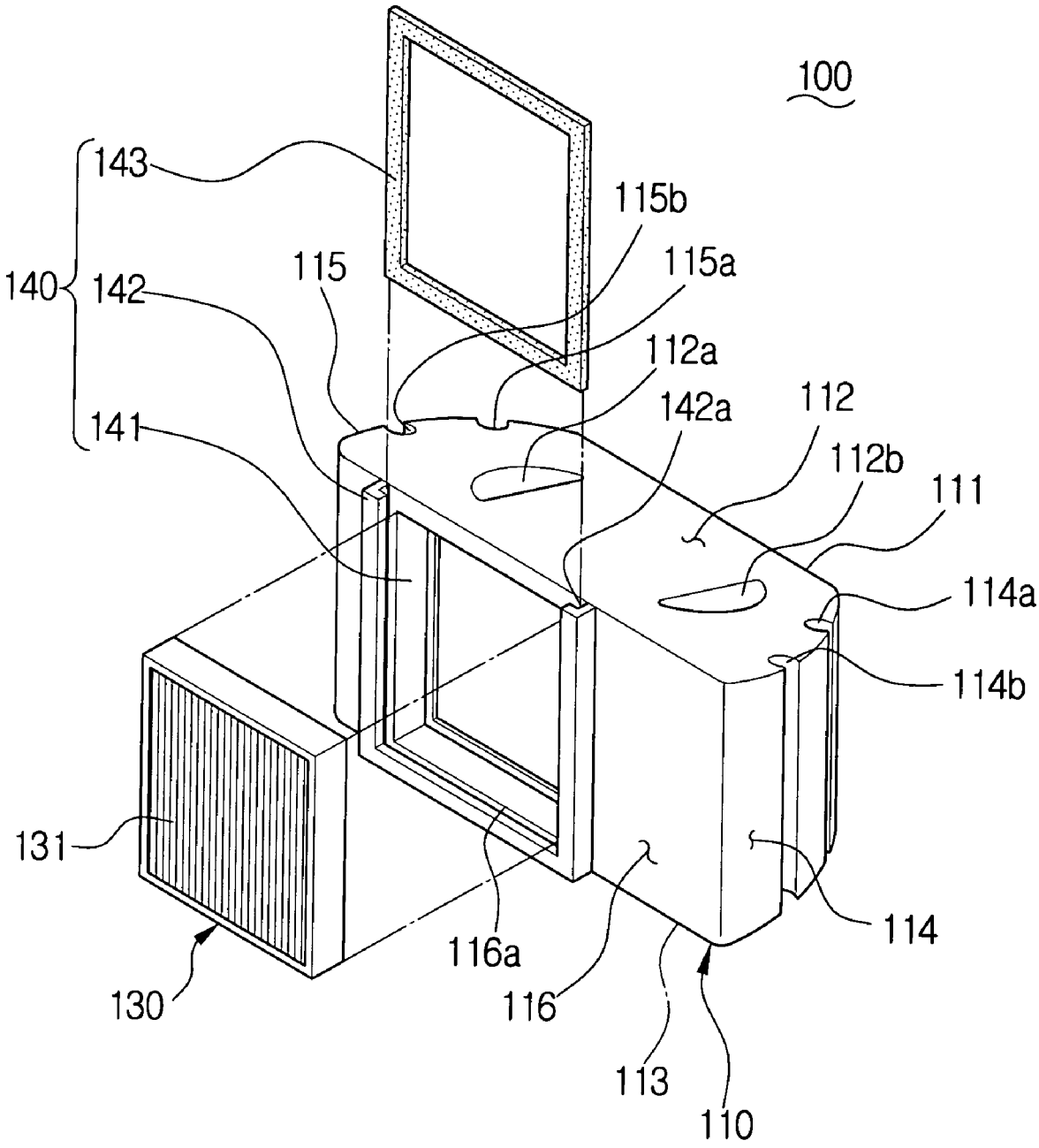
FIG. 2 is an exploded perspective view of the dust collecting container of FIG. 1.
Figure 3:
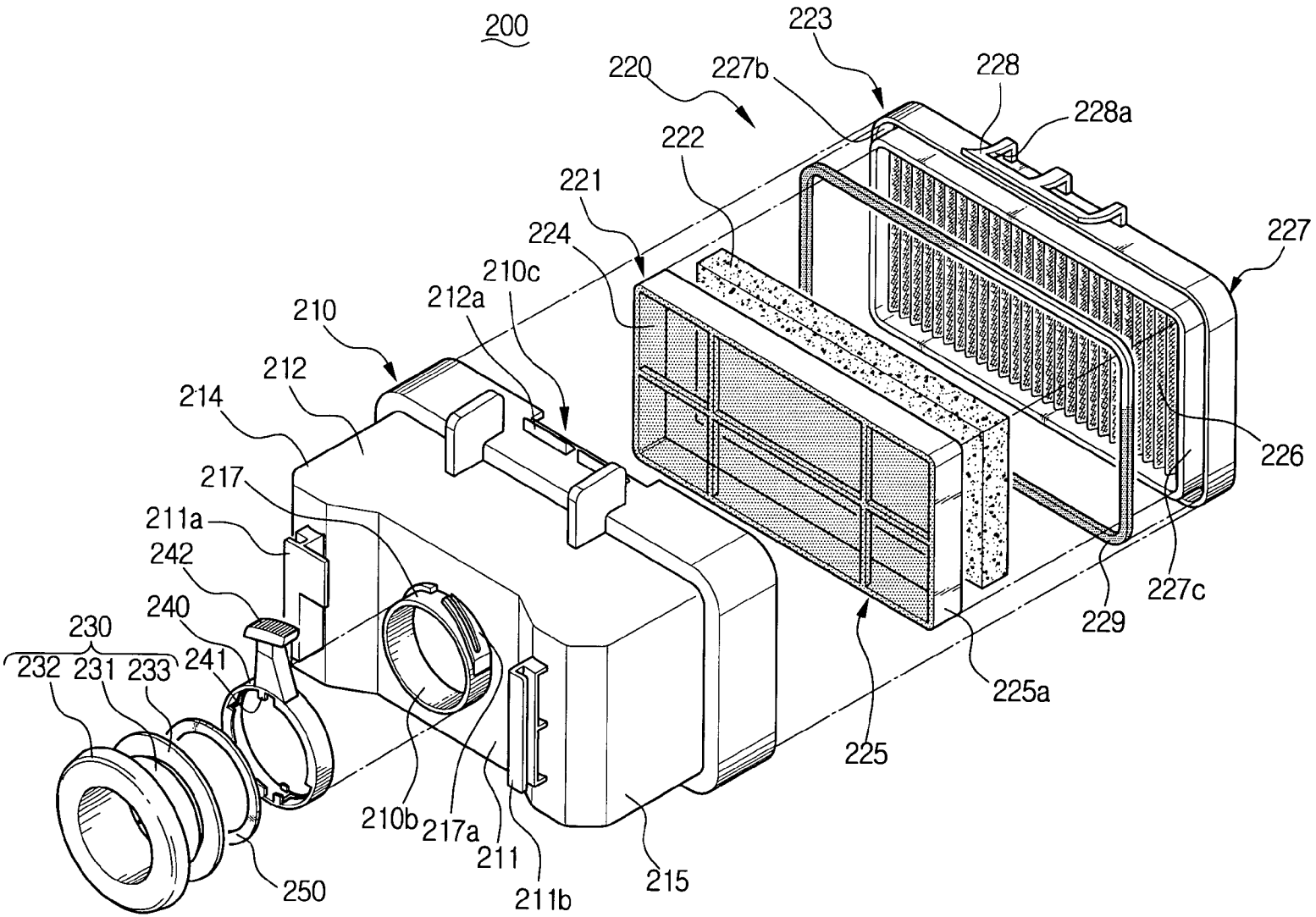
FIG. 3 is an exploded perspective view of a dust collecting container for a vacuum cleaner according to a preferred embodiment of the present invention.
Figure 4A:
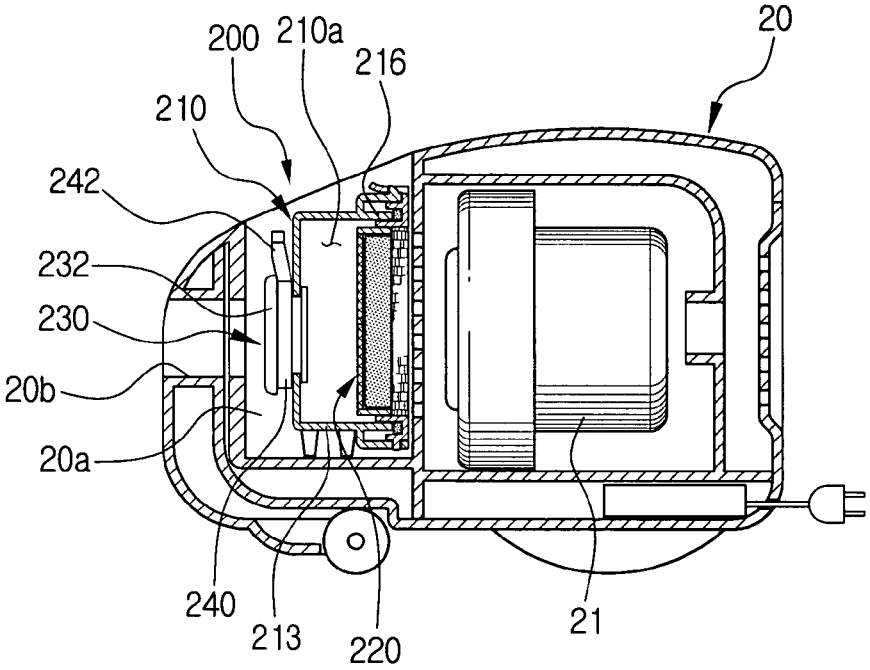
FIGS. 4A and 4B are sectional views illustrating the dust collecting container of FIG. 3 being mounted in the suction chamber of the vacuum cleaner according to the preferred embodiment of the present invention.
Figure 4B:
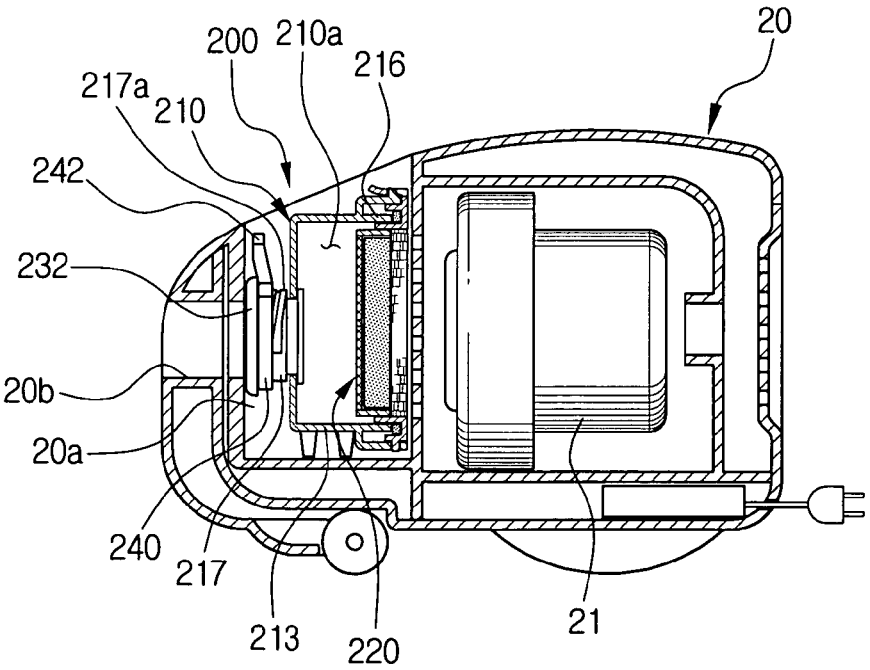

Referring to FIG. 3, the dust collecting container 200 for a vacuum cleaner according to the present invention includes a dust collecting casing 210 where a dust collecting chamber 210*a* (FIG. 4A) is provided to receive collected foreign substances, and a filter assembly 220 removably mounted in the dust collecting casing 210 to filter foreign substances from the dust-laden air drawn into the dust collecting chamber 210*a*.

The dust collecting casing 210 includes a front side 211 that has a connecting hole 210*b* formed therein to connect to an air suction hole 20*b* (FIG. 4A) of a cleaner body 20 (FIG. 4A), an upper side 212 extended from the upper portion of the front side 211, a lower side 213 (FIG. 4A) extended from the lower portion of the front side 211, and lateral sides 214, 215 extended from both sides of the front side 211. The rear portion of the dust collecting casing 210 is open to discharge air. There is an inner projection formed in the dust collecting casing 210, serving as a part of the dust collecting chamber 210*a* that collects foreign substances therein, and protruding toward the discharge portion 210*c* at the rear portion of the dust collecting casing 210. The dust collecting casing 210 may be made of transparent material for the user to check the collected amount of foreign substance of the dust collecting chamber 210*a* from outside.

Protruding from the front side 211 is an extended portion 217 which is extended outward from the connecting hole 210*b*, and an oblique guide rail 217*a* is provided around the outer circumference of the extended portion 217. The extended portion 217 is also provided with a first sealing member 230 for preventing creation of any nick between the connecting hole 210*b* of the dust collecting casing 210 and the air suction hole 20*b* of the cleaner body 20.

There is provided a press ring 240, which presses the first sealing member 230 toward the air suction hole 20*b*. The first sealing member 230 includes a body 231 being inserted to a contact with the inner circumference of the extended portion 217, a tight-contact portion 232 provided at an end of the body 231 to be extended from the outer end of the extended portion 217 toward the air suction hole 20*b*, and a backflow preventive portion 233 provided at the other end of the body 231 to prevent backflow of foreign substance of dust collecting casing 210. The press ring 240 is provided with a guide protrusion 241 formed at the inner circumference for being inserted in the oblique guide rail 217*a* of the extended portion 217, and a lever 242 formed at a side of outer circumference of the press ring 240 for the manipulation of the user. A washer ring 250 may be disposed between the tight-contact portion 232 and the press ring 240 of the first sealing member 230. As the user turns the lever 242 clockwise, the guide protrusion 241 is moved along the spiral guide rail 217*a* and subsequently, the press ring 240 is pushed outside of the extended portion 217. At this time, the press ring 240 presses the washer ring 250 and the tight-contact portion 232 of the first sealing member 230 towards the air suction hole 20*a* of the air suction hole 20*b* of the cleaner body 20, and the tight-contact portion 232 is deformed as it enters into contact with the wall of the cleaner body 20 and thereby sealing in between the air suction hole 20*b* and the connecting hole 210*b*.

Figure 5:
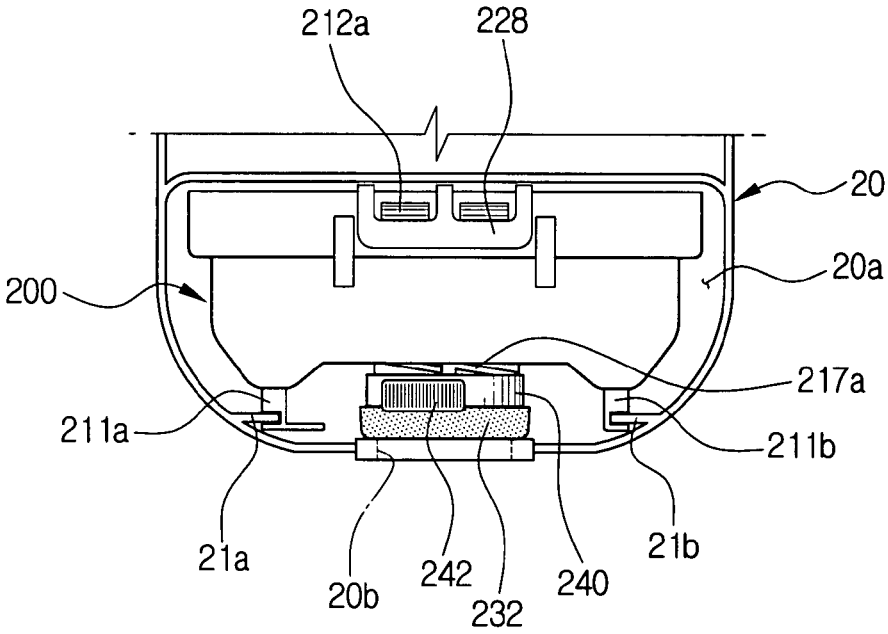
FIG. 5 is a plan view illustrating the dust collecting container of FIG. 3 being mounted in the suction chamber of the vacuum cleaner according to the preferred embodiment of the present invention.

On the front side 211 of the dust collecting casing 210 are formed a pair of fixing rails, i.e., left and right fixing rails 211*a*, 211*b* to correspond to the fixing ribs 21*a*, 21*b* (FIG. 5) that are provided inside the suction chamber 20*a* of the cleaner body 20. As the fixing rib 21 is slid in the fixing rails 211*a*, 211*b*, the dust collecting casing 210 is mounted on the suction chamber 20*a* of the cleaner body 20.

The filter assembly 220 is constructed such that it is provided with first to third filters 221, 222, 223 which are arranged in turn, and cover different filtering areas according to the size of the filtered dust particles and the size of pores formed therein. More specifically, the first filter 21 is for filtering relatively large particles of dust, and arranged in the innermost part of the dust collecting chamber 210*a* of the dust collecting casing 210. The first filter 221 is formed of a net member 224 having plurality of pores, which is relatively larger than those of other filters, for air to pass therethrough, and a frame 225 supporting the net member 224 and at the same time defining an appearance of the first filter 221. There also is a first outer wall 225*a* extended from the boundary of the frame 225.

Figure 6:
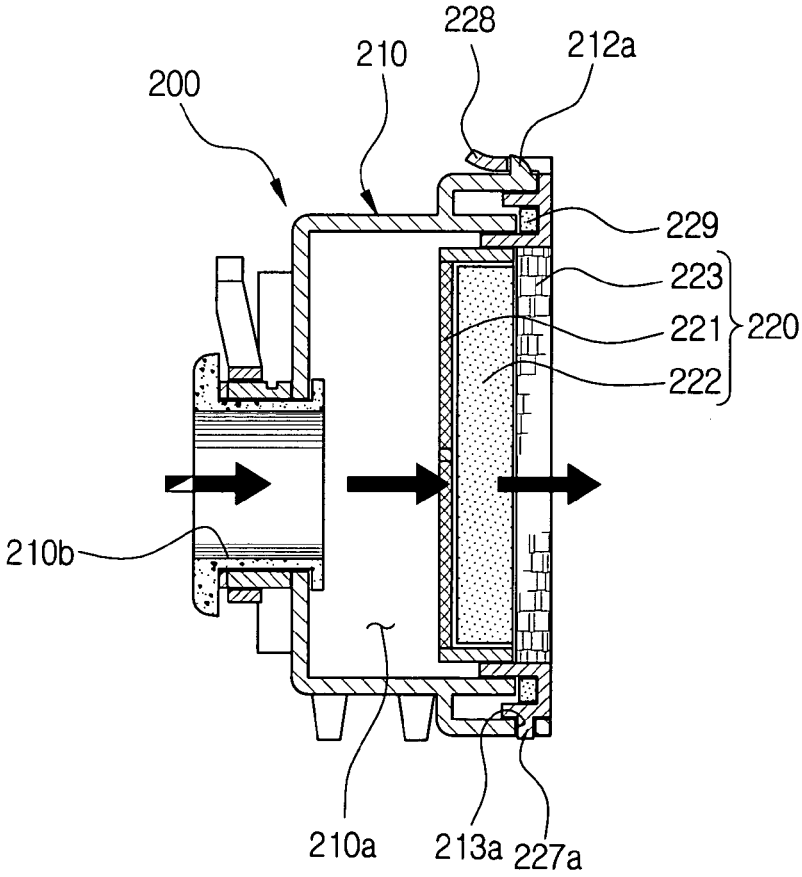
FIG. 6 is a sectional view illustrating the operation of the vacuum cleaner according to the preferred embodiment of the present invention of FIG. 3.

The third filter 223 is for filtering minute dust which are too small to be filtered at the first and the second filters 221, 222. The third filter 223 is arranged at the outermost part of the filter assembly 220. The third filter 223 includes a non-woven fabric 226 with small pores formed therein and an outer frame 227 supporting the non-woven fabric 226 and defining the appearance of the third filter 223. In order to increase filtering area, the non-woven fabric 226 is provided in the outer frame 227 in pleats of a predetermined size. Protruding from the upper portion of the outer frame 227 inwards the outer frame 227 is a hook member 228. The hook member 228 has a hook recess 228*a* that receives the hooking protrusion 212*a* at the outer portion of the upper side 212 of the dust collecting casing 210. Protruding from the lower portion of the outer frame 227 is a fitting rib 227*a* (FIG. 6) for being inserted in a slit 213*a* (FIG. 6) formed in the lower side 213 of the dust collecting casing 210. Inside the outer frame 227 is formed a second wall 227*c* fitted with the first wall 225*a* of the body 225 of the first filter 22. There is a fixing groove defined between the second wall 227*c* and the inner boundary of te outer frame 227. There is a sealing member 229 disposed along the fixing groove 227*b* in tight contact with the inner boundary 216 of the dust collecting casing 210, sealing the dust collecting chamber 10*a* air-tightly.

The second filter 222 is for filtering remaining dust after the filtering at the first filter 221, and is made of a sponge material that has pores relatively smaller than those of the net member 224 and larger that those of the non-woven fabric 226. The second filter 222 is disposed in the inner space which is defined by the cooperation of the first wall 225 of the first filter 221 and the second wall 227*c* of the third filter 223.

The dust collecting container 220 for the vacuum cleaner constructed as above being mounted in the cleaner body 20 and operating according to the present invention will be described with reference to FIGS. 4A to 6.

According to the present invention, the dust collecting container 200 for vacuum cleaner is made stationary in the suction chamber 20*a* of the cleaner body 20 as the fixing ribs 21*a*, 21*b* of the cleaner body 20 are slid into the fixing rails 211*a*, 211*b* of the dust collecting casing 210. Then by turning the lever 242 of the press ring 240, the press ring 240 is moved along the oblique guide rail 217*a* of the extended portion 217 in an oblique direction, pressing the tight contact portion 232 of the first sealing member 230 towards the air suction hole 20*b*. Accordingly, the connecting hole 210*b* of the dust collecting container 200 is connected with the air suction hole 20*b* without having any gap therebetween.

Then as the motor 21 is driven with the dust collecting container 200 being mounted in the suction chamber 20*a*, dust-laden air is sucked into the dust collecting chamber 210*a* inside of the dust collecting casing 210 through the suction hole 20*b* and the connecting hole 210*b*. Then the drawn air passes the first, the second and the third filters 221, 222, 223 of the filter assembly 220 in turn, and is then discharged out of the cleaner body 20. Accordingly, dusts are filtered at the filters, in the order of largest to the most minute particles, and collected.

As the dust collecting chamber 10*a* is filled with dusts, the dust collecting container 200 needs to be cleaned in order to prevent deterioration of suction force of the cleaner due to dust-clogging at the filters 221, 222, 223. To clean the dust collecting container 200, the user manipulates the lever 242 of the press ring 240 thus releases the suction hole 20*b* of the cleaner body 20 from the connection with the connecting hole 210*b* of the dust collecting container 200 and separates the dust collecting container 200 from the suction chamber 20*a*. Then by pulling up the hook member 228 of the filter assembly 220, the hooking protrusion 212*a* is released from the hooking hole 228*a*, and thus, the filter assembly 220 is separated from the dust collecting casing 210, opening the discharge portion 210*c* of the dust collecting casing 210. Then the user removes the dusts from the dust collecting casing 210 and the respective filters 221, 222, 223 of the filter assembly 220. After cleaning, the filters 221, 222, 223 and the dust collecting casing 210 are re-assembled and re-mounted in the suction chamber 20*a*.

According to the present invention, with the plurality of filters 221, 222, 223 that respectively and consecutively filter from the largest to the most minute particles of the dust-laden air drawn in the dust collecting chamber 210*a*, the dust collecting container 200 is rarely blocked even for a long period of use. As a result, the dust collecting container 200 needs no frequent cleaning, but can be used for a long period of time.

Furthermore, according to the present invention, since the dust-laden air passes the plurality of filters 221, 222, 223, the dust collecting container 200 has improved filtering efficiency.

Although the preferred embodiments of the present invention have been illustrated and described, it will be understood by those skilled in the art that the present invention should not be limited to the described preferred embodiments, but various changes and modifications can be made within the spirit and scope of the present invention as defined by the appended claims.

What is claimed is:

1. A dust collecting container for a vacuum cleaner, removably mounted in a suction chamber of a cleaner body to filter a dust from a dust-laden air being drawn into the suction chamber through an air suction hole that is connected with the outside, the dust collecting container comprising:

a dust collecting casing comprising a connecting hole connected with the air suction hole and a discharge portion for discharging the drawn air; and a filter assembly comprising at least three filters, and removably mounted at the discharge portion, wherein the filter assembly comprises first, second and third filters which are porous in nature and provided in a consecutive order, the pores of the second filter being smaller than those of the first filter, the pores of the third filter being smaller than those of the second filter, and the dust-laden air drawn in through the connecting hole passing through the first, the second and the third filters in turn, and wherein the third filter comprises:

an outer frame disposed in close contact with a boundary of a discharge portion of the dust collecting casing; and a non-woven fabric provided at the outer frame, defining a fluid passage through which the air is discharged from inside of the dust collecting casing to the outside and at the same time filtering minute particles from the air passed through the second filter.

2. The dust collecting container of claim 1, wherein the first filter is a net member.

3. The dust collecting container of claim 1, wherein the second filter is a sponge.

4. The dust collecting container of claim 1, wherein the third filter is a non-woven fabric.

5. The dust collecting container of claim 1 wherein the outer frame is provided with a hook member protruding outward for hooking with a hooking protrusion formed on an upper portion of the dust collecting casing.

6. The dust collecting container of claim 1, wherein the outer frame is provided with a connecting rib protruding therefrom for being inserted in a slit which is formed in the lower portion of the dust collecting casing.

7. The dust collecting container of claim 1, the dust collecting casing is provided with an extended portion formed on the connecting hole, the extended portion being provided with a sealing means for sealing in between the air suction hole and the connecting hole.

8. The dust collecting container of claim 7, wherein the sealing means comprises:

a first sealing member, extended at one end toward the outer side of the extended portion to a close contact with a boundary of the air suction hole; and a pressing means for selectively pressing the first sealing member towards the air suction hole.

9. The dust collecting container of claim 8, wherein the pressing means comprises:

a guide rail provided on the outer circumference of the extended portion in an oblique fashion; and a press ring provided with a guide protrusion at an inner circumference thereof for being inserted in the guide rail, the press ring disposed such that it is moved along the outer circumference of the extended portion with the guide rail thereof being inserted in the guide rail, wherein the pressing ring moving along the guide rail pushes the second sealing member towards the air suction hole.

10. The dust collecting container of claim 8, wherein the first sealing member comprises:

a body which is inserted to a contact with an inner circumference of the extended portion;

a tight-contact portion provided at one end of the body, protruding from the outer end of the extended portion towards the air suction hole; and a backflow preventing portion provided at the other end of the body, for preventing backflow of the dust of the dust collecting casing.

11. The dust collecting container of claim 1, wherein the outer frame is provided with a second sealing member provided at an inner boundary thereof, and in tight contact with an inner boundary of the dust collecting casing which defines a dust collecting chamber, and the dust collecting chamber is sealed as the second sealing member is contacted with the inner boundary of the dust collecting casing tightly.

12. The dust collecting container of claim 1, wherein the dust collecting casing is provided with a fixing rail at an outer portion thereof in correspondence with a fixing rib provided to a suction chamber of the cleaner body, and the dust collecting casing is mounted in the suction chamber as the fixing rib is inserted in the fixing rail.

13. The dust collecting container of claim 1, wherein the dust collecting casing is made of a transparent material.

* * * * *